United States Patent [19]

Nagase et al.

[11] 4,240,391

[45] Dec. 23, 1980

[54] FUEL SUPPLY CONTROL DEVICE FOR FUEL INJECTED INTERNAL COMBUSTION ENGINE

[75] Inventors: Hidenobu Nagase, Wako; Kiyoshi Miyaki, Asaka; Hiroshi Shirakura, Kamifukuoka; Yasuo Ohashi, Fujimi, all of Japan

[73] Assignee: Honda Giken Kogyo Kabushiki Kaisha, Tokyo, Japan

[21] Appl. No.: 965,875

[22] Filed: Dec. 4, 1978

[30] Foreign Application Priority Data

Dec. 19, 1977 [JP] Japan ..... 52-152540

[51] Int. Cl.[3] ..... F02B 3/00

[52] U.S. Cl. ..... 123/454; 123/455

[58] Field of Search ..... 123/139 AW, 139 BG, 123/32 AE, DIG. 14; 261/44 A

[56] References Cited

U.S. PATENT DOCUMENTS

| | | | |
|---|---|---|---|
| 3,688,754 | 9/1972 | Eckert | 123/139 AW |
| 4,096,838 | 6/1978 | Tanaka et al. | 123/139 BG |
| 4,100,904 | 7/1978 | Eckert | 123/139 AW |
| 4,105,000 | 8/1978 | Wessel | 123/139 AW |

*Primary Examiner*—Ronald B. Cox

*Attorney, Agent, or Firm*—Lyon & Lyon

[57] ABSTRACT

Constant differential pressure valves, one for each cylinder of the engine, supply liquid fuel to the injection nozzles. The liquid fuel supplied to the valves is delivered from a chamber within a metering member mounted to turn within the bore of a stationary sleeve. A plate carried by the metering member has notches on its periphery which cooperate with openings in the enclosing sleeve to form variable orifices. The metering member is turned in proportion to the rate of air flow through an air intake passage for the engine.

6 Claims, 3 Drawing Figures

FUEL SUPPLY CONTROL DEVICE FOR FUEL INJECTED INTERNAL COMBUSTION ENGINE

This invention relates to a control device for liquid fuel supply for an internal combustion multi-cylinder engine having a fuel injection nozzle for each cylinder. In the past, control devices of this type have required a fuel metering mechanism having a variable orifice of high precision manufacture, for minute metering of the quantity of liquid fuel supplied to each cylinder in proportion to the quantity of intake air. However, conventional methods of forming slits for the variable orifices require electrical discharge machining, which is disadvantageous for quantity production because of lengthy processing time and consequent high cost.

An important object of the present invention is to provide a control device for liquid fuel supply for an internal combustion multi-cylinder engine having fuel injection nozzles in which variable orifices are used which do not require electrical discharge machining and which greatly reduce the processing time and cost in mass production operations.

Other and more detailed objects and advantages will appear hereinafter.

Figure 1:
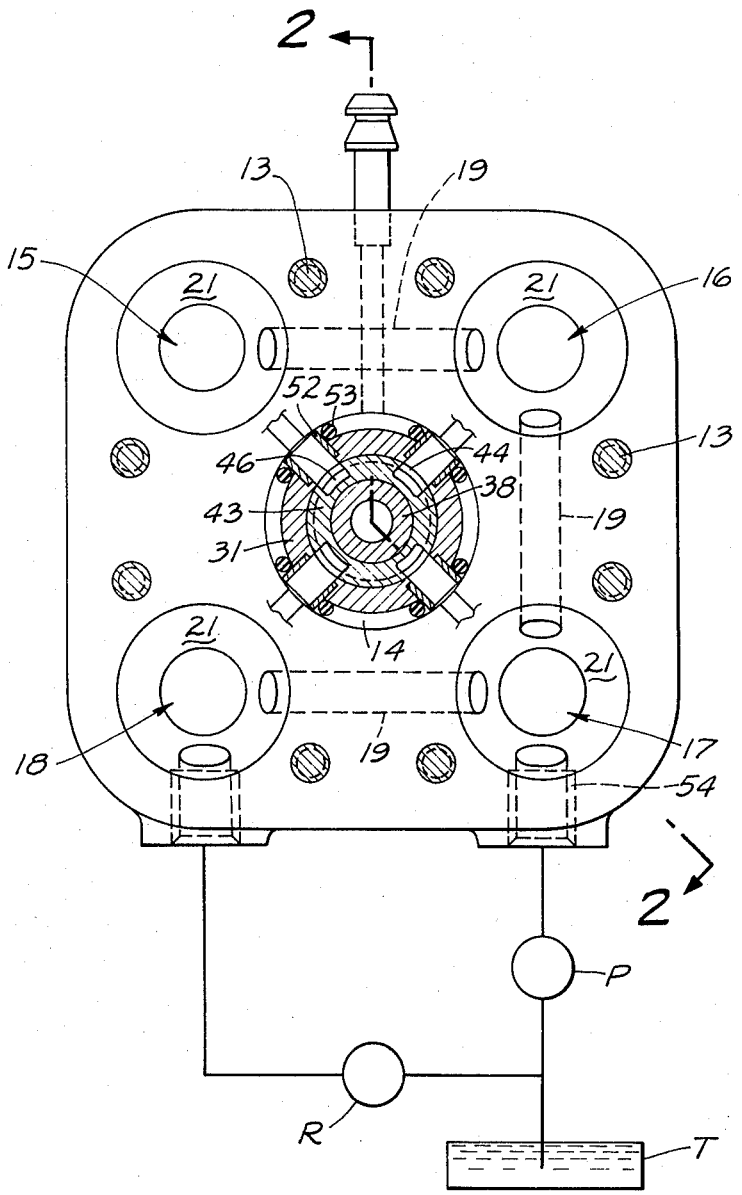
FIG. 1 is a sectional view taken substantially on the lines 1—1 as shown in FIG. 2, and showing a preferred embodiment of this invention.

Referring to the drawings, the housing 10 is formed of an upper housing part 11 and a lower housing part 12 connected by bolts 13. A thin metal diaphragm 14 is clamped between the housing parts 11 and 12. Four constant differential pressure valves 15, 16, 17 and 18 (one for each cylinder of the engine) are mounted on the upper housing part 11. The pump P delivers liquid fuel from the tank T to one of the constant differential pressure valves 17 and the liquid fuel is distributed to the other constant differential pressure valves 15, 16 and 18 through the communication passages 19 in the lower housing part 12. The liquid fuel is thus delivered to the upstream cavity 21 in each of the constant differential pressure valves. Each upstream cavity 21 is therefore filled with liquid fuel pressurized to a required pressure.

A fuel discharge passage 22 in each of the constant differential pressure valves is connected to each downstream cavity 23, and a valve body 24 is inserted into each one of the fuel discharge passages 22. A valve port 25 opening at the lower end of the valve body 24 is placed against the metal diaphragm 14 so as to be operated thereby. A diaphragm spring 26 of the compression type is placed in each downstream cavity 23 between its upper wall and the diaphragm 14. The downward force of this spring 26 pressure on the diaphragm 14 acts in a direction to open the valve port 25 of said valve body 24. Each fuel discharge passage 22 is connected through a passage 27 provided in a plug body 28, which passage 27 communicates with a fuel injection nozzle N through passage 29. There are four injection nozzles N and four constant differential pressure valves 15, 16, 17 and 18 because the engine for use of this device has four cylinders.

A vertical stationary sleeve 31 is fixed in the housing parts 11 and 12 and held in place by nut 32. The sleeve

31 has a central vertical bore 33 for reception of the multi-part metering member 34 which turns within the bore 33. The lower portion of the metering member 34 includes a shaft 36 having an enlarged head 37. The upper portion 38 has a cylindrical projecting part 39 press fitted into a bore 41 within the enlarged head 37, so that the upper and lower parts 38 and 37 function as a single integral unit. A plug 42 closes off the central bore 35 in the upper portion 38 of the metering member 34. A thin metal ring 43 is clamped between the upward facing shoulder 44 of the enlarged head 37 and the downward facing shoulder 45 on the upper portion 38 of the metering member 34. This annular ring 43 is provided with four peripheral notches 46. The ring 43 is fixed with respect to the upper and lower portions 38 and 37 of the metering member 34.

The shaft 36 of the metering member 34 is connected to turn with the pivot shaft 47 carrying the valve plate 48 mounted in the air intake passage 49 upstream from the throttle valve 66. Clockwise turning of the throttle valve 66 causes greater flow of air in the intake passage 49 thereby causing the plate 48 to swing in a clockwise direction. The movement of the pivot 47 causes turning movement of the shaft 36 and metering member 34 through a similar arc of travel. This in turn causes the notches 46 in the periphery of the metal ring 43 to move in an arc with respect to the radial openings 51 in the stationary sleeve 31. Short cylindrical sleeves 52 form extensions of the openings 51 and each projects beyond the outer surface of the stationary sleeve 31 and is encircled by a seal ring 53.

In operation, liquid fuel delivered by the pump P through the inlet fitting 54 fills the upstream cavities 21 in all four constant differential pressure valves 15, 16, 17 and 18. Liquid fuel then moves through the passage 55 and through the filter 56 into the annular groove 57 and through openings 58 into the fuel distribution chamber 59. From the fuel distribution chamber 59 the liquid fuel passes through ports 61 and into the annular chamber 62. The liquid fuel then passes through the radial notches 46 in the metal ring 43 to enter the openings 51 in the stationary sleeve 31. Each opening 51 communicates through a passage 63 in the upper housing part 11 with the downstream cavity 23 of one of the constant differential pressure valves 15, 16, 17 and 18. Liquid fuel then passes through the valve body 24 through clearance space provided by the diaghragm spring 26.

The metering of liquid fuel supplied to each fuel injection nozzle N is controlled by the angular position of the plate 48 in the air intake passage 49 for the engine. When the quantity of intake air increases, the valve plate 48 turns in a clockwise direction, as viewed in FIG. 2, to turn the metering member 34 in a direction to increase the delivery of liquid fuel through the peripheral notches on the metal ring 43. Thus each notch 46 is moved to increase its degree of registry with its respective opening 51. The difference in the pressure across the notches 46 is constant, and therefore an increase in opening area results in an increase in the quantity of fuel flowing therethrough, so that the quantity of fuel supplied to the fuel injection nozzle N is also increased. The peripheral notches 46 cooperate with the openings 51 to form variable orifices so that the quantity of liquid fuel injected into each cylinder of the engine can be increased in proportion to an increase in the quantity of intake air supplied to the internal combustion engine.

Figure 2:
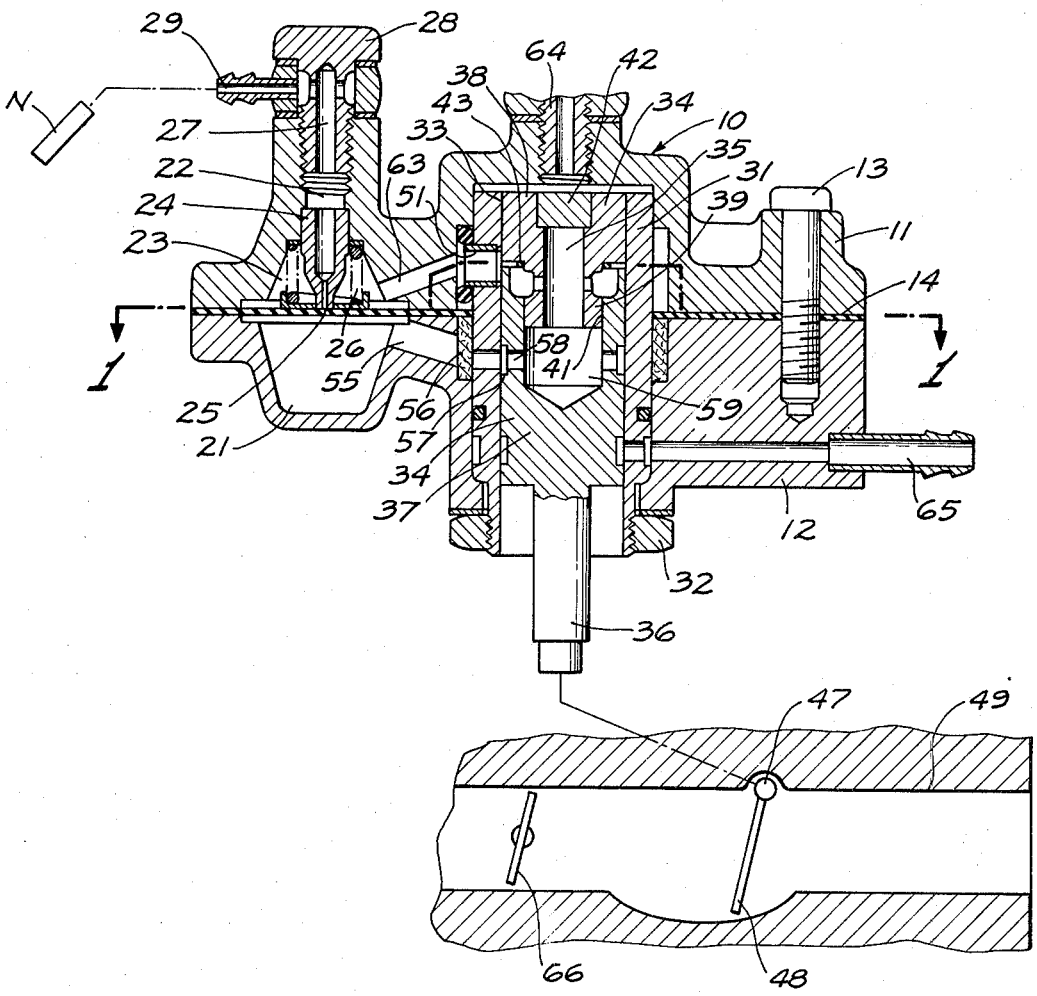
FIG. 2 is a sectional elevation taken substantially on the lines 2—2 as shown in FIG. 1.
Figure 3:
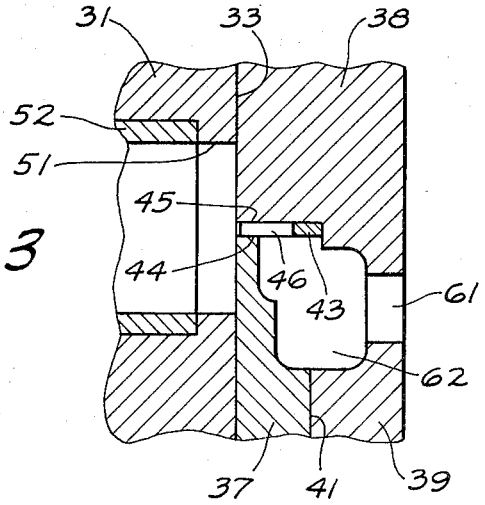
FIG. 3 is an enlarged sectional detail of a portion of the apparatus shown in FIG. 2.

Conversely, when the quantity of intake air flowing through the intake passage 49 decreases, the valve plate 48 turns counterclockwise, as viewed in FIG. 2, to turn the metering member 34 in a direction to reduce the communicating alignment between the notches 46 on the metal ring 43 and the openings 51 in the stationary sleeve 31. The quantity of liquid fuel supplied to the fuel injection nozzles N is decreased. In other words, the quantity of liquid fuel injected into each cylinder of the engine is decreased in proportion to a decrease in the quantity of intake air for the internal combustion engine.

Any leakage from the upper end of the metering member 34 passes through the fitting 64 in the upper housing part 11 and is returned through regulator R to the fuel tank T. Similarly, leakage past the lower portion of the metering member 34 escapes through fitting 65 to the regulator R. Also, leakage from the cavities 21 also passes through the regulator R to the fuel tank T.

The fuel injection nozzles N are of conventional design and are opened and closed in sequence in accordance with engine RPM.

In accordance with the present invention, the metering member 34 is turned in proportion to the quantity of intake air of the internal combustion engine. This metering member 34 is constructed of two separable parts clamping a thin metal plate between them. Peripheral notches in the plate register with openings formed in a stationary sleeve encircling the metering member, and the degree of registration depends upon the relative angular position of the metering member and the stationary encircling sleeve. Expensive electrical discharge machining is avoided and mass producibility of fuel metering mechanisms of high precision is provided. Furthermore, the size of the notches can easily be changed by changing the thin metal plates 43. The invention is thus readily applicable to various internal combustion engines differing in quantity of fuel to be injected.

Having fully described our invention, it is to be understood that we are not to be limited to the details herein set forth but that our invention is of the full scope of the appended claims.

We claim:

1. In a control device for liquid fuel supply for an internal combustion multi-cylinder engine having fuel injection nozzles, the combination of: a stationary housing having an upper part and a lower part, a metal diaphragm clamped between said housing parts, a plurality of constant differential pressure valves, each valve having an upstream cavity formed in the lower housing part and a downstream cavity formed in the upper housing part, said cavities being separated by said diaphragm, each constant differential pressure valve having a discharge passage for connection with a fuel injection nozzle, a valve body in each downstream cavity having a port closed by contact with said diaphragm, each downstream cavity containing a spring acting to apply a pressure against said diaphragm to move it in a direction to admit fuel from said upstream cavity into said valve body and discharge passage, a stationary sleeve mounted in both housing parts and extending through said diaphragm and having a central bore, a metering member mounted to turn in said bore and having a central chamber, means for delivering liquid fuel from said central chamber to each of said downstream cavities, a substantially flat ring having a notched outer periphery and a solid inner periphery mounted on said metering member, said substantially flat ring having a notched outer periphery and a solid inner periphery having a notched periphery, said stationary sleeve having a plurality of openings communicating with notches on said substantially flat ring having a notched outer periphery and a solid inner periphery to form variable orifices, passage means in said upper housing part establishing communication between said sleeve openings and said downstream cavities, and means for turning said metering member in proportion to the rate of air flow through an air intake passage for the engine.

2. In a liquid fuel supply control device for an internal combustion multi-cylinder engine having fuel injection nozzles, the combination of: a stationary housing having an upper part and a lower part, a metal diaphragm clamped between said housing parts, a plurality of constant differential pressure valves, one for each cylinder of the engine, each valve having an upstream cavity formed in the lower housing part and a downstream cavity formed in the upper housing part, said cavities being separated by said diaphragm, each constant differential pressure valve having a discharge passage for connection with a fuel injection nozzle, a valve body in each downstream cavity having a port closed by contact with said diaphragm, each downstream cavity containing a spring encircling the valve body and acting to apply a pressure against said diaphragm to move it in a direction to admit fuel from said upstream cavity into said valve body and discharge passage, a stationary sleeve mounted in both housing parts and extending through said diaphragm and having a central bore, a metering member mounted to turn in said bore and having a central chamber, said metering member and said sleeve having communicating passages for delivering liquid fuel from said central chamber to each of said downstream cavities, a substantially flat ring having a notched outer periphery and a solid inner periphery mounted on said metering member, said plate having a notched periphery, said stationary sleeve having a plurality of openings communicating with notches on said substantially flat ring having a notched outer periphery and a solid inner periphery to form variable orifices, passage means in said upper housing part establishing communication between said sleeve openings and said downstream cavities, and means for turning said metering member in proportion to the rate of air flow through an air intake passage for the engine.

3. The combination set forth in claim 2 in which said metering member is formed of two parts which clamp the notched substantially flat ring having a notched outer periphery and a solid inner periphery between them.

4. In a control device for liquid fuel supply for an internal combustion multi-cylinder engine having fuel injection nozzles, the combination of: a stationary housing having an upper part and a lower part, a metal diaphragm clamped between said said housing parts, a plurality of constant differential pressure valves, each valve having an upstream cavity formed in the lower housing part and a downstream cavity formed in the upper housing part, said cavities being separated by said diaphragm, each constant differential pressure valve having a discharge passage for connection with a fuel injection nozzle, a valve body in each downstream cavity having a port closed by contact with said diaphragm, each downstream cavity containing a spring acting to apply a pressure against said diaphragm to move it in a direction to admit fuel from said upstream cavity into said valve body and discharge passage, a stationary sleeve mounted in both housing ports and extending through said diaphragm and having a central bore, a metering member mounted to turn in said bore and having a central chamber, said metering member having a plurality of outlet passages communicating with said central chamber and an inlet passage connecting said central chamber to said upstream cavity, said stationary sleeve having a plurality of openings communicating with said outlet passages, passage means in said upper housing part establishing communication between said sleeve openings and said downstream cavities, a substantially flat ring having a notched outer periphery and a solid inner periphery fitted on an outlet opening of said outlet passage, means for turning said metering member in proportion to the rate of air flow through an air intake passage for the engine, said notched periphery notch cooperating with said sleeve opening to form a variable orifice dependant upon the turning of said metering member whereby the quantity of liquid fuel injected into each cylinder of the engine is controlled by said variable orifice.

5. The combination set forth in claim 4 in which said ring has a plurality of notches in the outer periphery thereof.

6. The combination set forth in claim 4 in which said metering member is formed of two parts which clamp the ring.

* * * * *